United States Patent [19]

Almond

[11] Patent Number: 4,972,864

[45] Date of Patent: Nov. 27, 1990

[54] TENT PEG COVER

[76] Inventor: Milton D. Almond, 518 Fieldstone Rd., Mooresville, N.C. 28115

[21] Appl. No.: 439,996

[22] Filed: Nov. 21, 1989

[51] Int. Cl.[5] ..... E04H 15/62

[52] U.S. Cl. ..... 135/118; 135/DIG. 9; 52/147; 273/55 D

[58] Field of Search ..... 135/118, DIG. 9; 52/DIG. 12, 309.4, 147, 301; 173/130; 273/55 D, 348, 411; 248/508; 16/DIG. 12, 110 R, 111 R, 114 R, 116 R

[56] References Cited

U.S. PATENT DOCUMENTS

| | | | |
|---|---|---|---|
| Re. 15,669 | 8/1923 | Hindmarsh | 173/130 |
| 476,424 | 6/1892 | Smith | 16/DIG. 12 |
| 735,205 | 8/1903 | Bunger | 135/118 |
| 1,096,264 | 5/1914 | Palmer | 16/DIG. 12 |
| 1,301,666 | 4/1919 | Downs | 173/130 |
| 1,443,596 | 1/1923 | Schaefer | 16/DIG. 12 |
| 1,444,834 | 2/1923 | Hindmarsh | 173/130 |
| 1,798,753 | 3/1931 | Paque | 52/301 |
| 3,319,328 | 5/1967 | Finger et al. | 52/301 |
| 3,782,724 | 1/1974 | Rottman et al. | 273/55 D |
| 3,814,118 | 6/1974 | Larson | 135/118 |
| 3,831,941 | 8/1974 | Pease | 273/55 D |
| 4,198,036 | 4/1980 | O'Neal | 273/55 D |
| 4,565,251 | 1/1986 | Cischke | 173/130 |

FOREIGN PATENT DOCUMENTS

| | | | |
|---|---|---|---|
| 3892 | of 1893 | United Kingdom | 16/DIG. 12 |

*Primary Examiner*—Henry E. Raduazo
*Assistant Examiner*—Lan Mai
*Attorney, Agent, or Firm*—Ralph H. Dougherty

[57] ABSTRACT

A cylindrical tube opened at one end and closed at the other is placed over a roughened upper of a stake such as a tent or canopy anchoring stake to prevent injury to passers by who move into contact with the roughened stake edge. The device is preferably made of a molded plastic, and brightly colored to provide a visual warning.

20 Claims, 2 Drawing Sheets

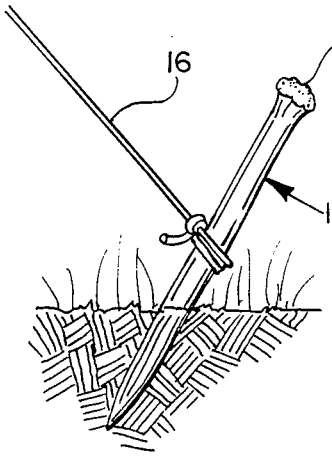
Fig. 5
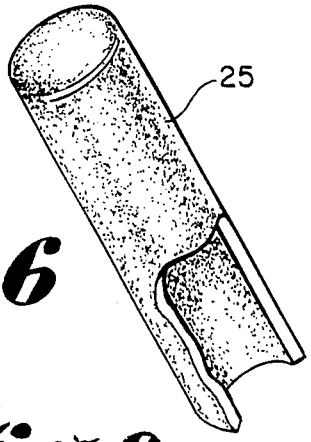
Fig. 6
Fig. 7
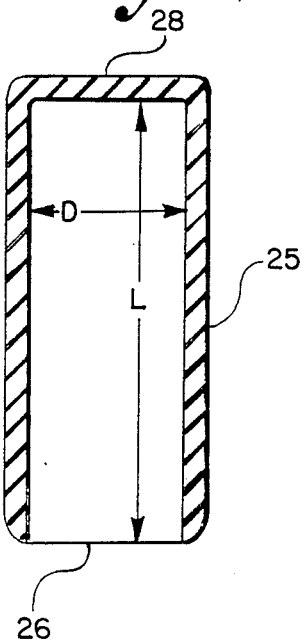
Fig. 9
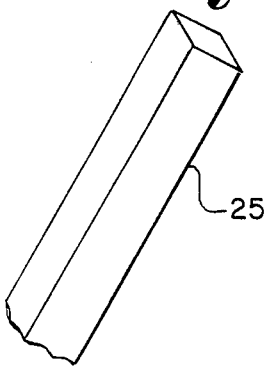
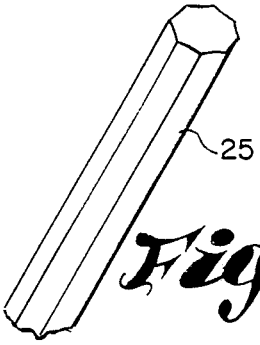
Fig. 10
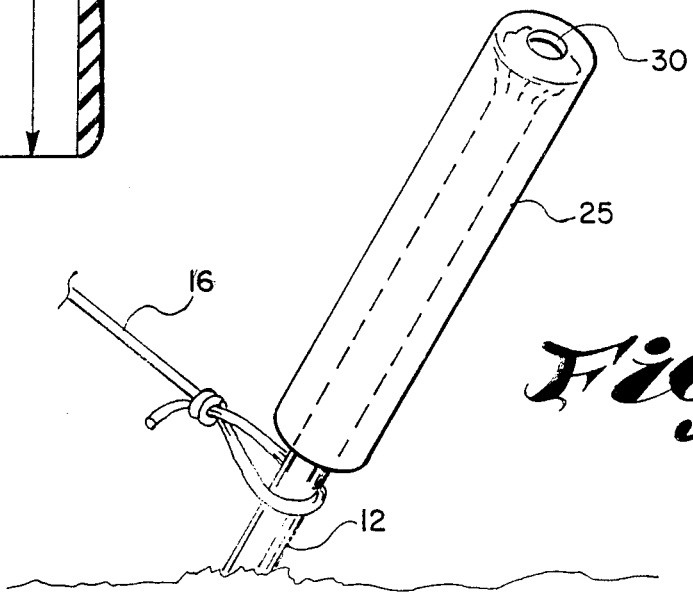
Fig. 8

TENT PEG COVER

BACKGROUND OF THE INVENTION

The present invention relates to protective devices for posts, stakes, pegs, and the like, particularly for pegs and stakes which are driven to hold support ropes and guy lines for tents, canopies, dining flies, and other camping equipment, circus tents, awnings, funeral canopies and other temporarily erected structures which are held in place by guy ropes and wires.

When a hammer or other driving tool impacts against the end of a tent peg, pin or stake, particularly a metal stake, the top of the stake flattens, frequently spalling and forming a rough, outwardly extending flange, which usually has sharp edges and tooth-like gaps or recesses capable of injuring a person or animal coming into contact with the damaged flange, which generally results in torn or otherwise damaged clothing such as pants, hose, or shoes, as well as bodily injuries, particularly to legs and ankles. This damage occurs in both metal and wooden stakes or pegs. When wooden stakes are utilized, slivers of wood are created and project outwardly from the roughened end, which causes similar injuries to those aforementioned.

DESCRIPTION OF THE PRIOR ART

The prior art contains many patents, most of which relate to caps which are used for driving fence posts and the like, to prevent damage to the post ends. Applicant is aware of the following prior art patents.

| U.S. Pat. No. | Inventor | Title |
|---|---|---|
| 1,444,834 | Hindmarsh | DRIVING CAP FOR FENCEPOSTS |
| 1,301,666 | Downs | POST DRIVING HEAD |
| 4,565,251 | Cischke | POST DRIVING DEVICE |
| 735,205 | Bunger | PIPE DRIVING HEAD |
| RE 15,669 | Hindmarsh | DRIVING CAP FOR FENCEPOSTS |
| 3,814,118 | Larson | TENT STAKE GUARD |
| 1,798,753 | Paque | PROTECTIVE CAP FOR METALLIC FENCE POSTS |

Fence post caps are generally complex devices, such as shown in Hindmarsh U.S. Pat. No. 1,444,834, or Cischke U.S. Pat. No. 4,565,251, and are employed to avoid damaging the upper ends of fence posts while they are being driven into the ground.

Paque U.S. Pat. No. 1,793,753 teaches a protective cap or cover for application to the top of a metallic fence post after it has been driven into the ground to protect it from the effects of the elements and from creating an unsightly appearance. This is specific to fence posts having T-shaped cross sections.

Larson U.S. Pat. No. 3,814,118 teaches a guard device for shielding the stake of a tent from passers by and is particularly drawn to a conical-shaped unit that is mounted about the tent stake and the anchor section of the attached tent rope. Larson's device is a high visibility shield having an axial slot along one side of the device to permit insertion of the device about a tent stake and tent rope. A belt is passed through a lower interior slot to anchor the device to a tent stake around which it is situated. This is merely a warning device and does not necessarily cover the exposed end of the stake as Larson shows in his FIG. 4.

SUMMARY OF THE INVENTION

The present invention is a safety cover or guard which is placed over the end of a stake after it has been driven, the cover being tubular and having rounded and smooth edges, which causes neither damage nor injury to a person impacting against it, nor to the person's clothing.

OBJECTS OF THE INVENTION

The principal object of the invention is to provide an improved means for preventing injury to a person coming into contact with a roughened driven stake or peg, as well as preventing damage to such person's clothing.

It is another object of this invention to provide an article of manufacture for protecting against leg injuries from a leg impacting against a driven stake, which article can be readily removed and stored.

It is also an object of this invention to provide a method for protecting against leg injuries around tents and canopies which are held in position by stakes.

It is also an object of this invention to provide a protection device for a driven stake which can be easily grasped and removed during all types of weather, including periods of inclement weather.

It is another object of this invention to provide a protection device for a driven stake which can be easily and inexpensively manufactured.

It is another object of this invention to provide a device for presenting a visual warning of a bumping or tripping hazard.

BRIEF DESCRIPTION OF THE DRAWINGS

The foregoing and other objects will become more readily apparent by referring to the following detailed description and the appended drawings, in which:

FIG. 5 is a front elevational view illustrating a wooden stake after driving, showing splintering and other damage to its head.

FIG. 6 is an isometric view of the invented leg guard device.

FIG. 7 is a cross-sectional view of the invented leg guard device.

FIG. 8 is an isometric view of the invented leg guard device in position on a tent stake.

FIG. 9 is an isometric view of an alternative embodiment of the invented leg guard device.

FIG. 10 an isometric view of another alternative embodiment of the invented leg guard device.

DETAILED DESCRIPTION

Figure 1:
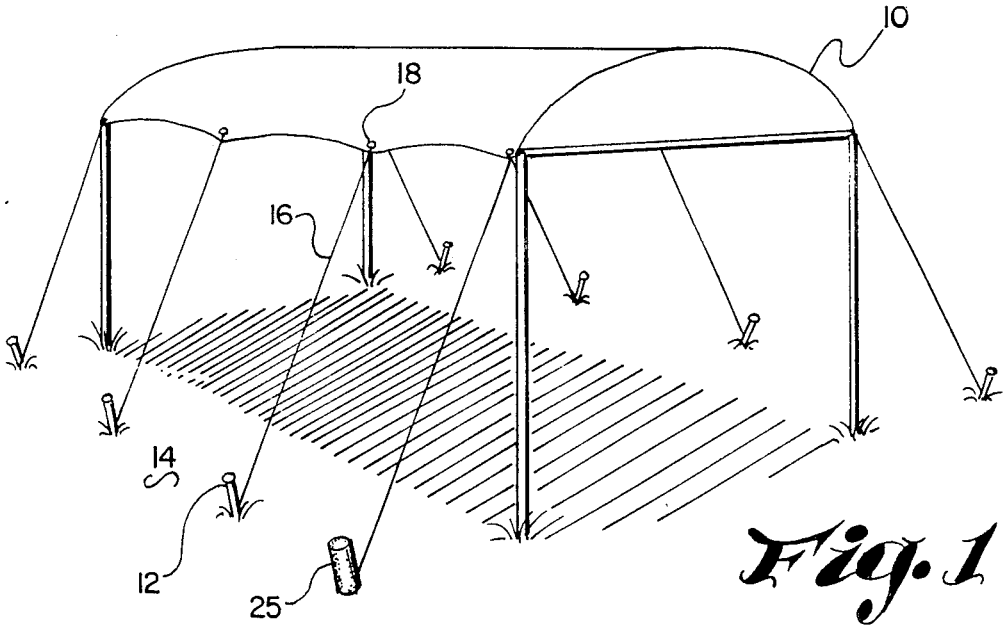
FIG. 1 is an isometric view of a funeral canopy held in place by guy ropes and driven stakes with the invented guard in place on one stake.
Figure 2:
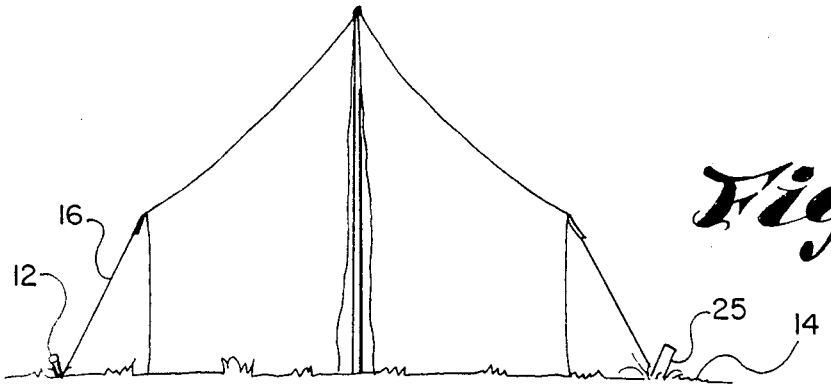
FIG. 2 is a front elevational view of a tent, tent stakes and guy ropes, with the invented leg guard device in place on one stake.
Figure 3:
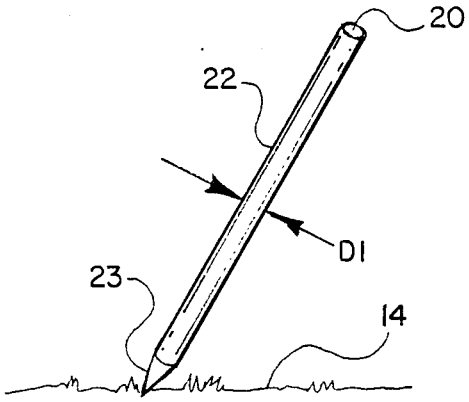
FIG. 3 is an elevational view of a new tent stake or pin without damage to its head before it has been driven into the ground.
Figure 4:
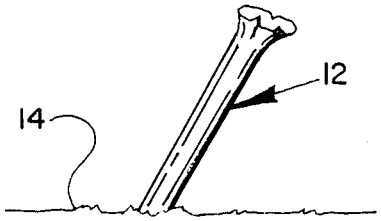
FIG. 4 is an elevational view of a metal tent stake after it has been driven into the ground, showing flaring and other damage to its head.

Referring now to the drawings and particularly to FIG. 1, a canopy 10, or other device such as a tent, is supported by stakes 12 inserted into the ground 14 and guy ropes 16, one end of Which rope is fastened to grommets 18 in the canopy 10 and the other end of which is fastened to the stakes 12. As shown in FIG. 3, stake 12 has an upper or head end 20, shank 22 having a cross-sectional diameter D1, and a pointed bottom end 23 for aiding in driving into the ground 14. The upper end 20 of each stake becomes somewhat flattened upon being pounded into the ground with a sledgehammer or other pounding device, and almost invariably develops a sharply flared or flanged rim in its upper end. Re-use of the stake will assure such damage to its upper end, particularly to a metal stake, as it becomes work hardened by the frequent hammer impact on it. Wooden stakes develop the same flared-type upper end from the sledgehammer pounding, which also creates myriads of splinters protruding in many directions from the head end of the stake.

A guard device 25, preferably formed of a plastic material, is tubular, having a lower (distal) open end 26 and an upper (proximal) closed end 28 and preferably has the shape of a cylinder. The internal diameter D (see FIG. 7) of the tubular guard 25 must be at least 1½ times the base diameter D1 of the shank 22 of the stake 12, if the stake is round, to accommodate the flared end, but is preferably about twice the base diameter of the shank 22 of the stake. If the stake is not round, but has some other geometric cross-section, the internal dimension D of the guard generally should be at least 1⅓ times the greatest dimension through a transverse cross-section of the shank of the stake. The internal length L of the tubular guard is preferably from 2.5 to 6 times the dimension D, but the length L of the guard can be from 1.5 to 10 times the dimension D.

Suitable materials for the guard device are soft or hard plastic, medium to high durometer natural rubber or synthetic rubber, wood, and sometimes even metal, although metal is the least desirable guard material.

Advantageously, the guard is made from a brightly colored plastic. If made of wood or other material, the guard may be painted a bright color. In either case, the bright color of the guard device will facilitate visual detection thereof and avoidance by persons in the vicinity of the stake.

The exterior surface of the guard can be smooth or lightly stippled, or a combination thereof, so long as there are no exposed sharp corners or edges. The stippled or rough surface shown in FIG. 6 allows firm grasping of the guard for handling, placement and removal during all types of weather, even during rain, snow, and sleet. All exterior corner and edges of the guard should be rounded, and preferably smooth.

The leg guard 25 is placed loosely over the stake 12, covering the roughened upper end 20. The looseness allows the device 25 to twist when contacted by a passer-by, the twisting or pivoting action of the guard device on the stake totally avoiding any injury to the passer-by, as the guard device prevents a passerby from impacting directly on or rubbing directly against the stake. This is particularly advantageous in protecting ladies' hosiery from tears and runs. The device is held in place by its own weight under the force of gravity. When contacted by a passerby, the device will lift slightly without falling off the stake or exposing the flared upper end. Thus, it has been found that the internal length of the guard should be at least 1.5 times its internal diameter, but preferably at least 2.5 times its internal diameter to assure its remaining in place on the stake merely by the force of gravity.

The device is particularly useful in the funeral industry, especially at grave-side services wherein the grave is covered by a canopy and large numbers of attendees are in close proximity to one another. A crowd of people in the limited space near the canopy-covered grave tends to force persons against the stakes holding the canopy in place, frequently causing tears to trousers, skirts, and hosiery, and causing abrasions and contusions to legs impacting against the stakes.

ALTERNATIVE EMBODIMENTS

The closed end 28 of the leg guard 25 may be provided with a hole 30 therethrough (see FIG. 8), for the purpose of drainage and cleaning, which is frequently necessary after removal of the equipment from a muddy site.

As shown in FIGS. 9 and 10, the leg guard or cover member 25 may have some other geometrical cross-section than round. The vertical cross-section of the cover member, however, will be identical to that shown in FIG. 7, but the dimension D will be the leas dimension taken through the center of the figure. As shown, the cover member may be square or hexagonal, or it may have some other cross-sectional shape. Regardless of the shape of the guard, all exterior corners and edges of the guard should be rounded, and preferably smooth.

SUMMARY OF THE ACHIEVEMENT OF THE OBJECTS OF THE INVENTION

From the foregoing, it is readily apparent that I have invented an improved safety device for preventing injury to a person coming into contact with a roughened driven stake or peg, the safety apparatus being easily and readily installed, removed and stored faster than heretofore has been possible, regardless of weather. The device also acts to provide a visual warning to persons in its vicinity. I have also invented a method for protecting against leg injuries around tents and canopies which are held in position by stakes and ropes more economically than heretofore has been possible.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. In combination with a stake driven into the ground, the stake having a head end portion and a shank portion, a guard device for shielding said stake from injury to a passer-by, comprising a tubular cover member having an opened distal end and a closed proximal end, the interior cross sectional dimensions being adapted for fitting loosely over said stake, wherein the smallest interior cross sectional dimension of said tubular cover member is at least 1⅓ times the greatest cross sectional dimension of said stake.

2. The combination of claim 1 wherein said tubular cover member is cylindrical.

3. The combination of claim 2 wherein the interior length of said tubular cover member is from 1.5 to 10 times the internal diameter of said tubular cover member.

4. The combination of claim 2 wherein the interior length is from 2.5 to 6 times the internal diameter of said tubular cover member.

5. The combination of claim 2 wherein the stake is round, and the interior diameter of said tubular cover member is at least 1.5 times the diameter of the shank of said stake.

6. The combination of claim 1 wherein said tubular cover member has a regular polygon cross-section.

7. The combination of claim 6 wherein said tubular cover member has a square cross-section.

8. The combination of claim 6 wherein said tubular cover member has a hexagonal cross-section.

9. The combination of claim 6 wherein the interior length is from 1.5 to 10 times the greatest internal cross-sectional dimension of said tubular cover member.

10. The combination according to claim 1 wherein all exterior corners of the cover member are rounded.

11. The combination according to claim 1 wherein all exterior corners of the cover member are smooth.

12. The combination of claim 1 wherein the tubular cover member is made of a material selected from the group consisting of: hard plastic, soft plastic, high and medium durometer natural rubber, high and medium durometer synthetic rubber, wood, and metal.

13. The combination of claim 12 wherein the material from which said tubular cover member is made is a colored material.

14. The combination according to claim 12 wherein said tubular cover member is painted a bright color.

15. The combination according to claim 1 wherein the closed proximal end of the cover member is provided with an axial hole therethrough having a diameter less than the greatest cross sectional dimension of said stake.

16. The combination according to claim 1 wherein the cover member has a rough exterior on at least a portion thereof.

17. The combination according to claim 16 wherein the cover member has a multi-faced exterior.

18. The combination according to claim 1 wherein the cover member has a smooth exterior.

19. A method of preventing injury to a passer-by from impacting against a roughened exposed end of a stake or post driven into the ground, comprising:

(a) providing a cylindrical tube open at one end and closed at the other, and having an internal tube length from 1.5 to 10 times its internal diameter and having an internal diameter greater than the greatest cross-sectional dimension of the stake; and (b) placing said tube loosely over the exposed end of the stake, whereby the tube is free to pivot about the stake, and the end of the stake is prevented from protruding from the tube.

20. A method according to claim 19 wherein the internal length of the cylindrical tube is from 2.5 to 6 times is internal diameter.

* * * * *

UNITED STATES PATENT AND TRADEMARK OFFICE

CERTIFICATE OF CORRECTION

PATENT NO. : 4,972,864

DATED : November 27, 1990

INVENTOR(S) : Milton D. Almond

It is certified that error appears in the above—identified patent and that said Letters Patent is hereby corrected as shown below:

Column 2, line 67, change "Which" to -- which --

Column 3, line 48, change "corner" to -- corners --

Column 4, line 19, change "leas" to -- least --

Column 6, line 26, change "is" to -- its --

Signed and Sealed this

Seventeenth Day of May, 1994

*Attest:*

*Attesting Officer*

Bruce Lehman

BRUCE LEHMAN

*Commissioner of Patents and Trademarks*